United States Patent [19]

Ashley

[11] 4,180,284

[45] Dec. 25, 1979

[54] TAG FOR IDENTIFYING LUGGAGE AND METHOD OF USING SAME

[76] Inventor: James E. Ashley, 19626 SE. 395th Ave., Sandy, Oreg. 97055

[21] Appl. No.: 849,807

[22] Filed: Nov. 9, 1977

[51] Int. Cl.[2] ..... G09F 3/00

[52] U.S. Cl. ..... 283/20; 40/6

[58] Field of Search ..... 283/6, 18, 19, 20, 21, 283/22; 40/6

[56] References Cited

U.S. PATENT DOCUMENTS

| | | | |
|---|---|---|---|
| 2,235,791 | 3/1941 | Wohlers | 283/18 |
| 3,967,022 | 6/1976 | Hasei | 283/18 X |
| 3,994,085 | 11/1976 | Groselak et al. | 283/6 X |

*Primary Examiner*—Travis S. McGehee

*Attorney, Agent, or Firm*—Chernoff & Vilhauer

[57] ABSTRACT

A kit for marking, identifying and controlling the transport of luggage is comprised of a tag arranged for attachment to a piece of luggage and having located on its face one of a selected group of distinctive geometrical shapes which is colored in one of a selected group of colors and which has an alphanumeric character located within the borders of the geometrical shape. Thus by having a large group of shapes, colors and alphanumeric characters, a very large number of identifying indicia is available, each of which is readily differentiable even at a distance and by an untrained observer. As an aid in communicating the identification of a particular geometrical shape, color and alphanumeric character combination, a group of identifying letters is marked on the tag, with the letters being uniquely associated with the particular combination of geometrical shape, color and alphanumeric character located on the tag. The kit also includes a user card having the same color geometrical shape and alphanumeric character as on the associated tag, and a post card having spaces for placement of the user's personal identification and addressed for return to the supplier of the kit. The method includes attaching the tag to a piece of luggage prior to transport by a carrier, and returning the filled-in post card to the supplier. After the luggage has been transported by the carrier the user can easily identify it and retrieve it from a baggage claim area due to the readily recognized identifying indicia located on the tag. In the event that the luggage should become misplaced, the carrier and the supplier can cooperate to locate it and inform the user of its whereabouts by using the information indicated on the post card.

2 Claims, 6 Drawing Figures

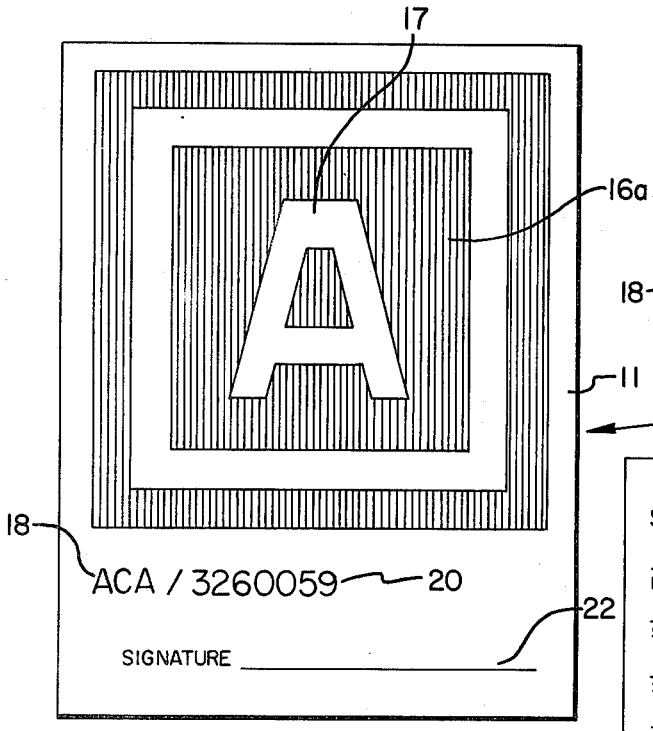
FIG. 1
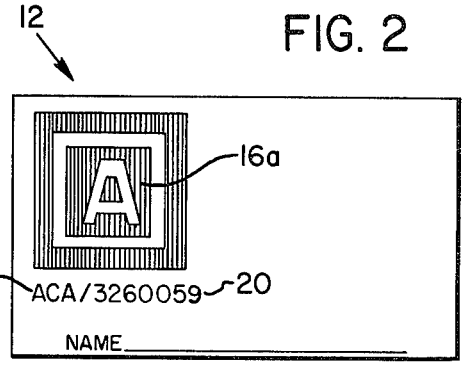
FIG. 2
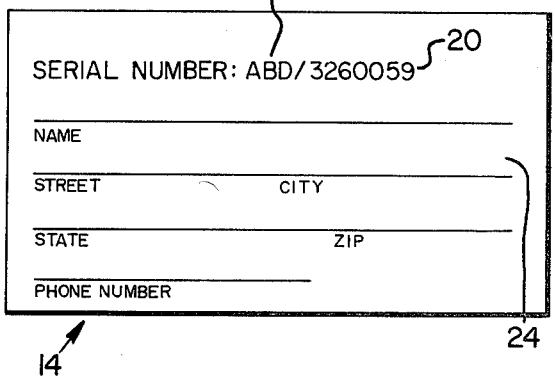
FIG. 3
FIG. 5
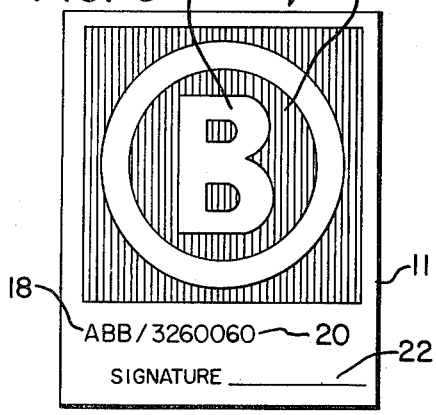
FIG. 6
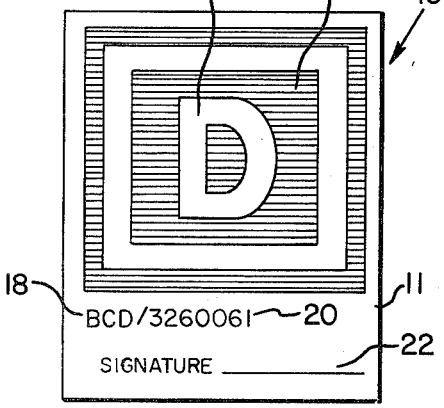
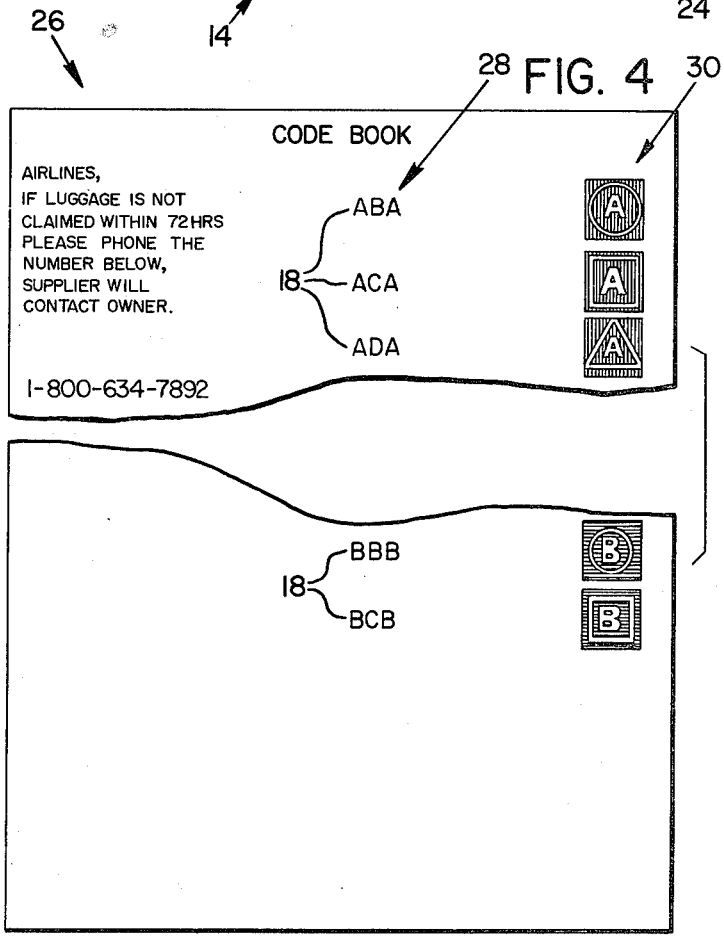
FIG. 4

TAG FOR IDENTIFYING LUGGAGE AND METHOD OF USING SAME

BACKGROUND OF THE INVENTION

This invention relates to a method for marking luggage so that it can be easily identified, and to a kit containing the necessary elements for this purpose.

When luggage is transported by a common carrier it often is difficult for the user to identify it promptly at the claim area and to secure its return in the event that it becomes lost in transport. This particularly is true in airline travel where a large amount of luggage is transported together and is unloaded at a single time and place The prior art tags which are used for marking luggage generally contain the user's name and/or an identification number, which due to their length necessarily must be made quite small. Accordingly, they are difficult to read without close examination. Therefore the prior art tags do not allow a person seeking to locate a particular piece of luggage to do so by quickly scanning the unloading area. Further, the present tags of this class are not readily adaptable to a computer operated luggage handling system, particularly in regard to reuniting the owner and his luggage in the event that the luggage becomes lost.

SUMMARY OF THE INVENTION

The present invention includes a tag arranged for attachment to a piece of luggage and having located on it one of a selected group of distinctive geometrical shapes which is colored in one of a selected group of colors and which has an alphanumeric character located within the boarder of the geometrical shape. The geometrical shape and alphanumeric character are of sufficient size to be recognizable from a distance, thereby permitting the piece of luggage to be easily identified when mixed with other similar pieces of luggage, such as in an airport baggage claim area. Associated with each combination of geometrical shape, color and alphanumeric character is a particular group of identifying letters, thus allowing transmittal of the identification indicia on the tag in an abbreviated form, as is necessary for example for computer initiated communication to a remote terminal. The tag is provided in a kit along with a user card containing the same color geometrical shape, alphanumeric character and identifying number, and a post card having spaces for insertion of the user's personal identification information and self-addressed for return to the supplier of the kit. For foreign travel the back side of the user card can have instructions in several languages to porters describing how to locate luggage with the aid of the tag.

In use the tag is attached to a piece of luggage prior to its transportation and the luggage is then placed in the carrier's normal luggage handling apparatus. The user fills out the post card and returns it to the supplier and retains the user card himself as a means of reminding him of the particular geometrical shape, color and alphanumeric character combination of the tag on his luggage.

When the luggage is unloaded at its destination in the carrier's baggage claim area, the user can, as a result of the unique identifying indicia on the tag, readily identify and claim his luggage without close examination as is necessary with the prior art luggage marking tags.

In the event that the luggage become lost during handling, the tag, in conjunction with the personal information on the post card, can be used by the carrier and supplier to easily locate the luggage and to reunite the user with it. Also when the inquiry in regard to lost luggage is initiated by the user, the identifying letters can be transmitted to all of the carrier's locations allowing personnel to be informed of the geometrical shape, color and alphanumeric character on the tag without the necessity of a detailed description of this information.

Accordingly, it is a principal objective of the present invention to provide a luggage identification tag of the class described which contains one of a group of easily recognizable combinations of identifying indicia.

It is a further object of the present invention to provide such an identification tag wherein the potential number of identifying indicia is large.

It is a further object of the present invention to provide such a luggage identification tag wherein the identifying indicia are readily distinguishable from each other.

It is a further objective of the present invention to provide a method for the use of the aforementioned luggage identification tag.

It is a still further objective of the present invention to provide such a method which is simple to use in operation.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a plan view showing a preferred embodiment of the luggage tag of the present invention.

FIG. 2 is a plan view of a user identification card which is used in conjunction with the tag of FIG. 1.

FIG. 3 is a plan view of a post card which is used in conjunction with the tag of FIG. 1.

FIG. 4 is a plan view of a code book which is used in conjunction with the three aforementioned items.

FIGS. 5 and 6 are plan views of tags similar to that shown in FIG. 1 except having different identifying indicia located thereon.

DETAILED DESCRIPTION OF THE INVENTION

Referring to FIGS. 1, 2 and 3 of the drawings, the present invention comprises a kit for marking, identifying and controlling the transportation of luggage by a public carrier. The kit, which is purchased by the user prior to shipment of the luggage, basically comprises a tag 10 having means for fixation to the luggage, a user card 12 which is retained by the user, and a post card 14 which is addressed for return to the supplier who initially provided the kit.

Tag 10 comprises a planar label 11, which is large enough to be visable from a considerable distance, preferably having an adhesive coating on its back surface covered by a peelable protective backing sheet (not shown). Thus by removing the backing sheet the label can be readily secured to a piece of luggage by application of pressure. This particular adhesive means is well known in the prior art and is preferred in that it provides convenience in handling of the label. The label has defined on its face one of a selective group of distinctive geometrical shapes 16 which covers a significant portion of the label so that it also is readily visable from a distance. The geometrical shape in turn is colored by one of a selected group of colors. In addition a large block alphanumeric character 17 is located within the borders of the geometrical shape in order to further distinguish that particular label. Accordingly, by providing a large number of geometrical shapes (such as squares, circles, triangles, various polyhedrons, etc.), a large number of colors and a large number of alphanumeric characters (such as the letters of the alphabet) there is a very large number of easily-identifiable identifying indicia. For example, the label in FIG. 1 is shown as displaying a red square 16*a* with an "A", the label in FIG. 5 as displaying a red circle 16b with a "B", and the label in FIG. 6 as displaying a blue square 16c with a "D".

Also located on label 10 is a group of identifying letters 18 which is uniquely associated with the particular combination of geometrical shape, color and alphanumeric character indicated on that label. In the embodiment illustrated there are three letters in each group; the first being associated with the color of the geometrical design (for example "A" indicates red and "B" indicates blue), the second being associated with its design (for example "B", FIG. 5, indicates a circle and "C", FIG. 6, indicates a square), and the third indicating the alphanumeric character (in this instance the corresponding letter). Therefore the particular combination on a label can be communicated merely by transmittal of the identifying letters.

Also located on each label is a serial number 20 which is unique to that label for absolute identification of the luggage in the unlikely event that two labels having the identical combination of geometrical shape, color, and alphanumeric character are placed on physically confusing pieces of luggage. A signature line 22 is provided on the label as another means of absolute identification.

User card 12, FIG. 2, which preferably is wallet sized, contains the same color geometrical shape, alphanumeric character, group of identifying letters and serial number as the label which it is supplied with. Accordingly, the user card serves as a means of reminding the user of the geometrical shape, color and alphanumeric character on the tag on his luggage and for associating him with the luggage if the question of ownership arises. The size of the card is arranged such that it can be carried with the user during his travels. Instructions for using the tag are located on the back of the user card in several languages to allow the user to direct a porter to assist him.

Post card 14 which is addressed for return to the supplier of the kit, has imprinted on its reverse side the same group of identifying letters and serial number as the assoicated label in the kit and in addition has spaces 24 for placement of the user's personal identification, such as name, address and telephone number. Thus by mailing the post card the user records with the supplier the identifying indicia associated with his kit.

Another element of the invention is a code book 26, FIG. 4, which is supplied to the carriers which will be transporting luggage identified by the tag of the present invention. This book lists each of the geometrical shapes in every color and with every alphanumeric character in a first column 28, with the corresponding groups of identification letters being listed in an adjacent second column 30, so that a person can quickly determine the identification letter group which goes with any geometrical shape-color-alphanumeric character combination and vice versa. Also the book directs the carriers to contact the supplier and inform him of the identification letters on the tag of any piece of unclaimed luggage in the carrier's possession. Thereby the supplier can inform the user of this fact by means of the personal identification supplied on the post card.

The method by which the invention is used comprises making kits available for purchase at the point of departure, each containing one tag 10, one user card 12, and one post card 14. The kits can be sold either by way of a vending machine or through the carrier, and if desired the carrier can supply the kits to their customers as part of its baggage control system. The tag and user card in each kit have the same geometrical shape 16 imprinted thereon in the same color with the same alphanumeric character, and all three elements in the kit are marked with the group of identification letters associated with that shape, color and alphanumeric character. It will be noted that by providing a large group of geometrical shapes in combination with a wide range of colors and alphanumeric characters there is available a very large group of readily recognizable identifying indicia. Therefore every tag received from a particular source will be unique with respect to every other tag issued from that source within a long time span.

The user then affixes tag 10 to his luggage by removing the protective backing, thus exposing the adhesive, and pressing it in place on the luggage. He retains the user identification card for future reference and sends post card 14 to the supplier after filling in the appropriate personal identification information in spaces 24. The luggage is then given to the carrier for placement into its normal baggage handling system.

When the user reclaims his luggage after his trip it is readily spotted and positively identified due to the easily noticed identifying indicia on the tag located on it. Since no other similar marked tag should have been issued at that source, the tag therefore should positively identify the luggage. However, in the event that a similarly marked tag was placed on a physically similar piece of luggage which was transported that particular trip by that particular carrier, then the serial number can be used to distinguish them.

A second feature of the subject system, besides uniquely marking the luggage for rapid identification and recovery, comes into play in the event that the tagged luggage becomes lost. If this occurs the luggage will normally turn up elsewhere in the carrier's facilities. Then the carrier can contact the supplier who can notify the user at the location indicated on the post card 14. On the other hand when the search is instituted at the direction of the user, either by contacting the supplier or carrier, only the identifying letters and serial number need to be transmitted to the carrier's personnel. They then can use the code book 26 to determine what geometrical shape, color and alphanumeric character to search for. This feature is particularly useful when the information is transmitted to a number of remote computer terminals from a central location.

Where the instant invention is used directly by the carrier, the post card can be omitted and the information normally associated with this element can be entered into a computer through a terminal at the location where tagging of the luggage occurs. In this case control and handling as well as location of lost luggage can be automated.

Also, the code book can be translated into appropriate foreign language versions for use by carriers having overseas operations.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A kit for marking, identifying and controlling transport of luggage comprising:

(a) a tag including a planar label, means for attaching said label to a piece of luggage, said label having one of a selected group of distinctive geometrical shapes defined thereon, said geometrical shape being sufficiently large to be identifiable from a location separate from said piece of luggage, said geometrical shape being colored in one of a selected group of colors, and an alphanumeric character displayed on said label within the border of said geometrical shape;

(b) a user card having indicated thereon the same geometrical shape, color, alphanumeric character and identifying letters as said tag; and (c) a postcard, addressed for return to its predetermined supplier, having imprinted thereon the same identifying letters as on the tag, and containing spaces for placement of the user's personal identification.

2. The kit of claim 1 including a code book, said code book listing the particular group of identifying letters associated with each possible combination of said geometrical shapes, colors and alphanumeric characters.

* * * * *